United States Patent [19]

Lewallyn

[11] 4,223,851

[45] Sep. 23, 1980

[54] CARPET TUBE DISPENSER

[76] Inventor: Michael A. Lewallyn, P.O. Box 1361, Dalton, Ga. 30720

[21] Appl. No.: 33,689

[22] Filed: Apr. 26, 1979

[51] Int. Cl.[3] ..... B65H 17/08

[52] U.S. Cl. ..... 242/66; 221/200

[58] Field of Search ..... 242/66, 67.1 R, 56 A, 242/DIG. 3; 221/200, 224, 266

[56] References Cited

U.S. PATENT DOCUMENTS

| | | | |
|---|---|---|---|
| 1,235,765 | 8/1917 | Brown | 221/200 X |
| 1,327,058 | 1/1920 | Ogden | 221/266 X |
| 1,450,839 | 4/1923 | Cusick | 221/266 X |
| 2,586,424 | 2/1952 | Gazette | 221/200 X |
| 3,910,517 | 10/1975 | Harrison | 242/66 |
| 4,102,512 | 7/1978 | Lewallyn | 242/66 |

*Primary Examiner*—Edward J. McCarthy

*Attorney, Agent, or Firm*—Jones, Thomas & Askew

[57] ABSTRACT

A carpet tube dispensing apparatus, used in combination with a carpet roll-up machine, comprises a large hopper for holding a number of tubes therein and an outlet from which tubes can leave the hopper for use in the roll-up machine. A tube collecting and dispensing device is located at the outlet opening to regulate the dispensing of tubes and provide only one tube at a time for use in the roll-up machine, and a tube stirring device stirs the tubes within the hopper to loosen entangled tubes and insure that tubes flow freely to the outlet opening.

5 Claims, 5 Drawing Figures

90
91
92
97
86
87
88
94
95
96
M
70
81
81a
99
82
81b
102
101
83
103
104
106
84
85

CARPET TUBE DISPENSER

DESCRIPTION

Technical Field

The disclosed invention relates generally to machinery used in the carpet industry for rolling carpet which is to be shipped or stored, and more specifically to an apparatus for automatically dispensing cardboard tubing, about which carpet can be rolled, into a carpet roll-up machine.

BACKGROUND OF THE INVENTION

When preparing carpet for storage or shipment, it is usually desirable to roll the carpet about an elongated tube or core to form the carpet into a large spiral roll. This keeps the spiral roll from being flattened when the roll rests on the floor or is stacked among other rolls. The central tube usually is a long hollow cardboard tube of twelve to fifteen feet in length and about four inches in diameter. Prior to use, the cardboard tubes usually are delivered to the carpet manufacturer in large bundles of fifty-two tubes bound together by steel cables. The carpet is rolled in large roll-up machines such as, for example, the roll-up machine disclosed in U.S. Pat. No. 4,102,512, Lewallyn, and the cardboard tubes are placed into the roll-up machine prior to rolling of the carpet. The cardboard tubes may be placed in the machine by hand or automatically by tube dispensing machines. Typically, automatic tube dispensing machines have experienced problems of the tubes becoming twisted and jammed within the dispensing machinery, resulting in delays in the roll-up process and damaging the tubes.

SUMMARY OF THE INVENTION

Briefly described, the present invention discloses an automatic tube dispensing machine which lessens the likelihood of twisting and binding tubes and dependably dispenses tubes one at a time for use in roll-up machines. The tube dispensing machine comprises a hopper including an outlet at the lower end of the hopper. The outlet is designed to allow only one tube to leave the hopper at a time and a plurality of discs mounted on and rotatable with a rotatable bar positioned beneath the outlet act as a gate to block the exit of tubes from the hopper. A groove of a size suitable for accepting the diameter of a single tube therein is defined in each of the discs and the grooves of all the discs are aligned to define a cradle for the tube. When the grooves are in alignment with the hopper outlet, one tube will fall from the hopper to be cradled by the discs and as the rotatable bar is rotated, the cradle forming aligned grooves move away from the outlet to a position where the tube will be dispensed from the cradle into a roll-up machine, and the discs block the outlet until the cradle is again aligned with the outlet. The tube dispensing machine further comprises a device which stirs the tubes within the hopper to keep the tubes in fluid and approximately parallel arrangement relative to one another in order to lessen the possibilities of the tubes becoming twisted and bonded within the hopper.

Therefore, it is an object of the present invention to provide a tube dispensing machine which retains a plurality of tubes within the machine and reliably dispenses the tubes one at a time.

Another object of the present invention is to provide a tube dispensing machine which stirs the tubes within the machine to inhibit twisting and binding of the tubes.

Yet another object of the present invention is to provide a carpet roll up system which combines a tube dispensing machine with a carpet roll-up machine.

Other objects, features and advantages of the present invention will become apparent upon reading the following specification, when taken in conjunction with the accompanying drawings.

DETAILED DESCRIPTION

Figure 1:
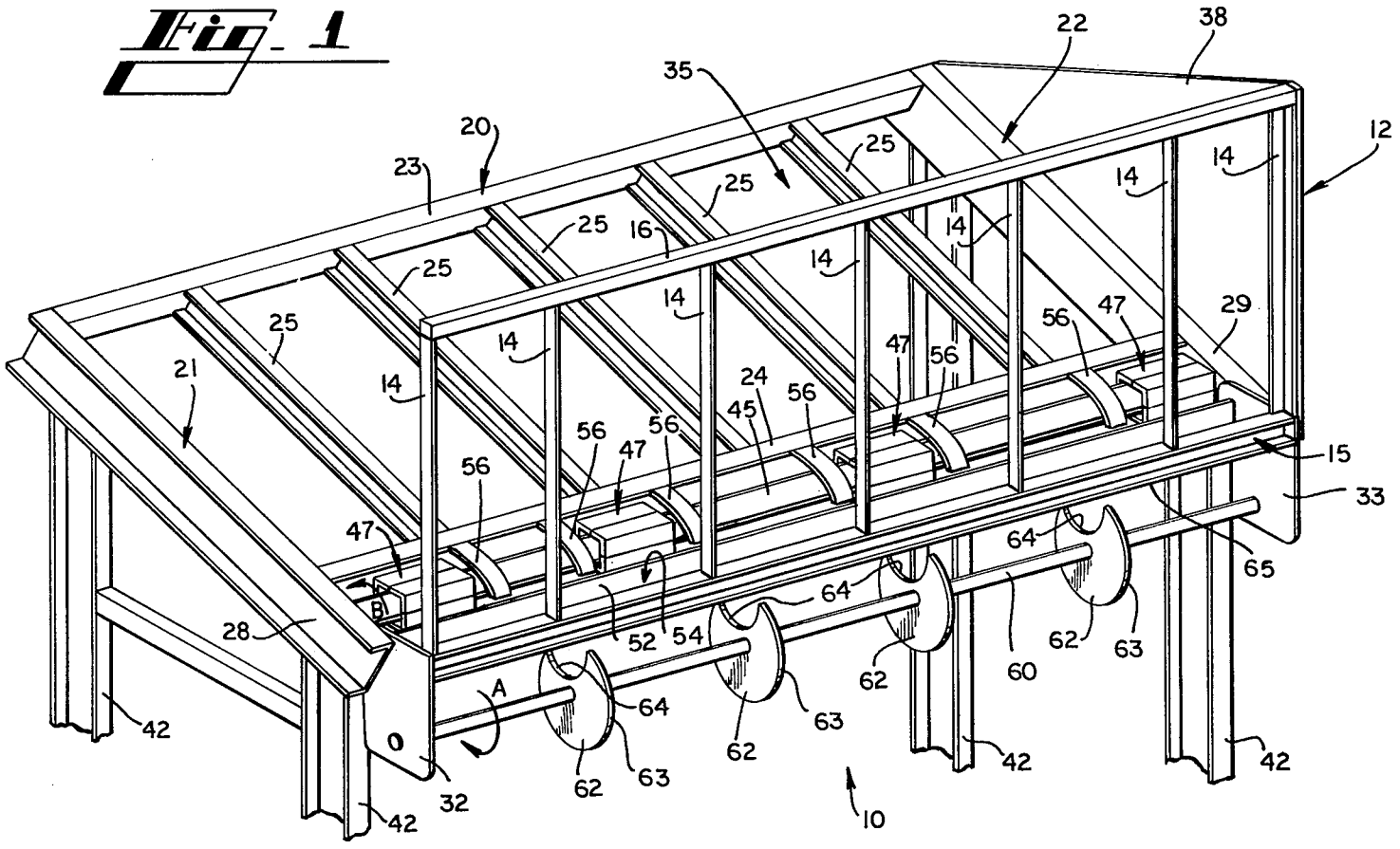
FIG. 1 is a pictorial view of the tube dispensing apparatus in accordance with the present invention.
Figure 2:
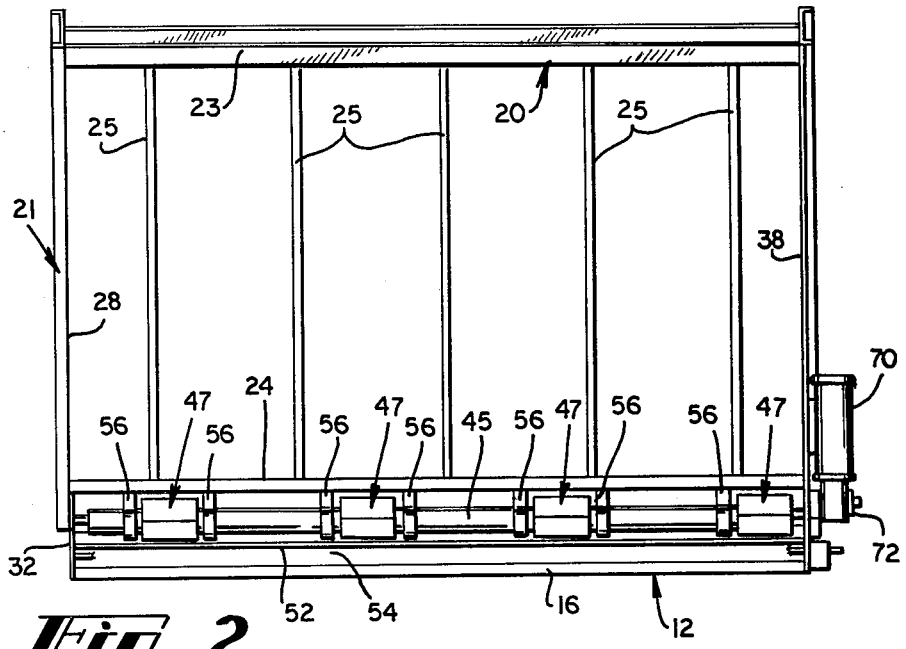
FIG. 2 is a top view of the tube dispensing apparatus of FIG. 1.

Referring now in greater detail to the drawings in which like numerals represent like components throughout the several views, FIG. 1 shows the tube dispensing apparatus 10 of the present invention. The dispensing apparatus 10 comprises a front rail 12 made of a framework of vertically oriented posts 14 mounted on a lower horizontal beam 15 and topped by an upper horizontal beam 16. An inclined structural wall 20 extends upwardly at an angle behind the front rail 12 from adjacent the lower horizontal rail 15. The inclined structural wall 20 is made of a framework including two parallel side beams 21, 22; a top beam 23 and a bottom beam 24 each extending perpendicular to the side beams, and a plurality, five in the disclosed embodiment, of spaced apart beams 25 extending parallel to the side beams between the top and bottom beams. The two side beams 21, 22 extend beyond the bottom beam 24 to define side beam extensions 28, 29 which attach to vertical end plates 32, 33. The front rail 12 is attached to the end plates 32, 33 at opposite ends of the lower horizontal beam 15. The front rail 12 and inclined structural wall 20 define a hopper 35 therebetween. A triangular end wall 38 joins the front rail 12 and inclined wall 20 at one end of the hopper 35 while the other end of the hopper is left open. Reinforcement plates 39, 40 extend along the triangular end wall 38 between the front rail 12 and inclined wall 20. The hopper 35 is supported at a desired height above the ground surface by legs 42 attached to the side beams 21, 22 of the inclined structural wall 20.

A space is defined at the bottom of the hopper between the bottom beam 24 of the inclined wall 20 and the lower horizontal beam 15 of the front rail 12. This space shall be referred to hereafter as the outlet portion of the hopper 35. An elongated roller 45 is mounted for rotating movement between the side beam extensions 28, 29 within the outlet portion of the hopper 35 and adjacent the bottom beam 24 of the inclined wall 20. Four cubes 47 are attached to and are rotatable with the roller 45 with the roller passing through the cubes. Each cube 47 is, in the preferred embodiment, formed of four 90 degree angle irons 49 attached to the roller 45, as by welding, with the legs 50 of the angle irons being tangent to the roller surface. The angle irons 49 are joined at the roller 45, and protrude outwardly from the roller surface. Preferably, the cubes 47 are all similarly oriented on the roller 45 with their angles or ridges 51 in alignment and the flat surfaces in alignment.

An elongated plate 52 extends between the two side beam extensions 28, 29, and is positioned between the roller 45 and the lower horizontal beam 15 of the front rail 12. A long, narrow opening 54, being the outlet opening of the hopper 35, is defined between the elongated plate 52 and the lower horizontal beam 15 and between the two side beam extensions 28, 29. The opening 54 is at least as wide as the diameter of each carpet tube and is narrower than the combined diameters of any two carpet tubes. Finger-like shield plates 56 are attached to the bottom beam 24 of the vertical wall 20 at a number of locations, six locations in the disclosed embodiment, and extend over the roller 45 to the elongated plate 52. The shield plates 56 are positioned close enough to the roller surface such that, as the roller 45 rotates, the ridges 51 of the protruding angle irons 49 forming the cubes 47 protrude above the shield plates.

A bar 60 is mounted for rotating movement between the two vertical end plates 32, 33 with the bar in vertical alignment with and below the centerline of the long narrow outlet opening 54. Four discs 62 are mounted on and are rotatable with the bar 60 at spaced apart intervals along the bar. Each disc 62 includes a groove 64 formed therein in the form of a circular arc. The radius of each groove 64 is at least larger than the radius of a carpet tube 120 (see FIG. 3) to be dispensed by the apparatus 10. Each groove 64 is located within the circle of the respective disc 62 such that a radius of the disc 62 forms a perpendicular bisector of the circular arc of the groove. All of the grooves 64 are in horizontal alignment with one another. The disc and bar assembly is positioned with the outer periphery 63 of the discs 62 located close enough to the outlet opening 54 that the distance between the periphery 63 of each disc and the lower edge 65 of the lower horizontal beam 15, and also the distance between the outer periphery 63 of each disc and the lower edge 66 of the elongated plate 52, is less than the diameter of a carpet tube 120.

Figure 4:
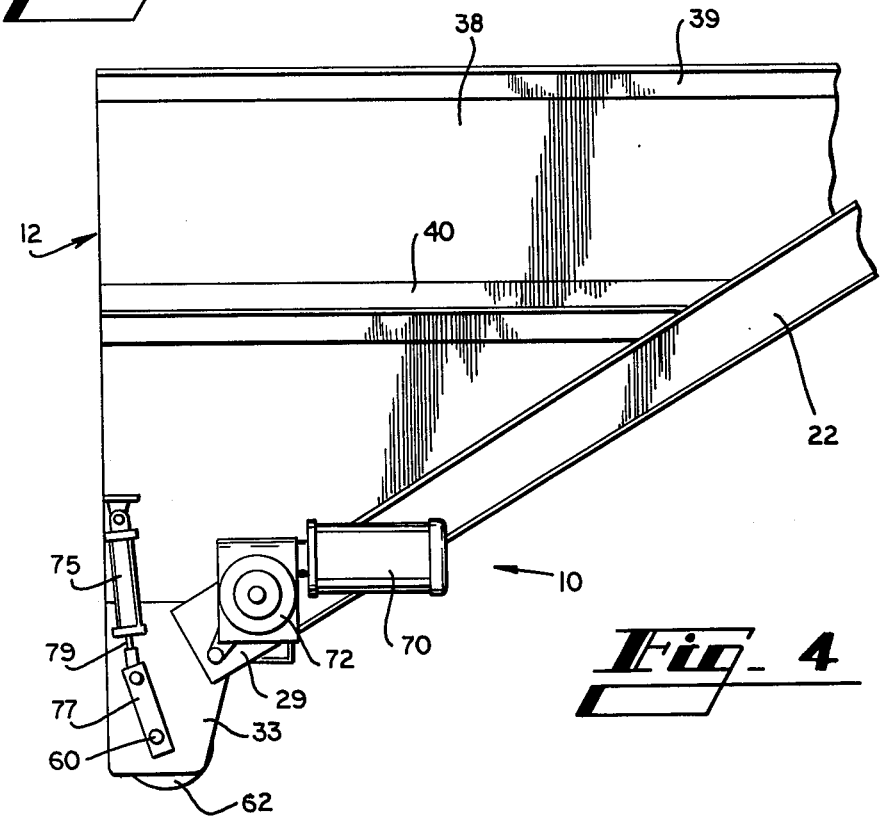
FIG. 4 is a right side view of the tube dispensing apparatus of FIG. 1.

An electric motor 70 (see FIG. 4), being the roller operating motor, is mounted to the side beam 22 of the inclined wall 20. The output shaft (not shown) of the motor 70 is connected through a gear reduction unit 72 to the turn shaft (not shown) of the elongated roller 45. A pneumatic cylinder 75, being the disc operating cylinder, is mounted to the end wall 38 of the hopper 35 above the bar 60. A link 77 is attached to the bar 60 so as to be rotatable with the bar and connects one end of the bar 60 to the extendable ram element 79 of the pneumatic cylinder 75. With the ram element 79 in its fully retracted position, or the at-rest position, the bar 60, and thus discs 62, are rotated such that grooves 64 are oriented above the bar 60 and in line directly beneath the outlet opening 54. In this position, the disc and bar assembly is in the tube-collecting position. As the ram element 79 is extended, the link 77 pivots to rotate the bar 60 and the discs 62 in the direction of arrow A in FIG. 1 such that the groove 64 move away from the tube-collecting position until, at the full extension of the ram element, the grooves reach a position where the tubes 120 will roll out of the grooves. This is the tube-dispensing position.

Figure 5:
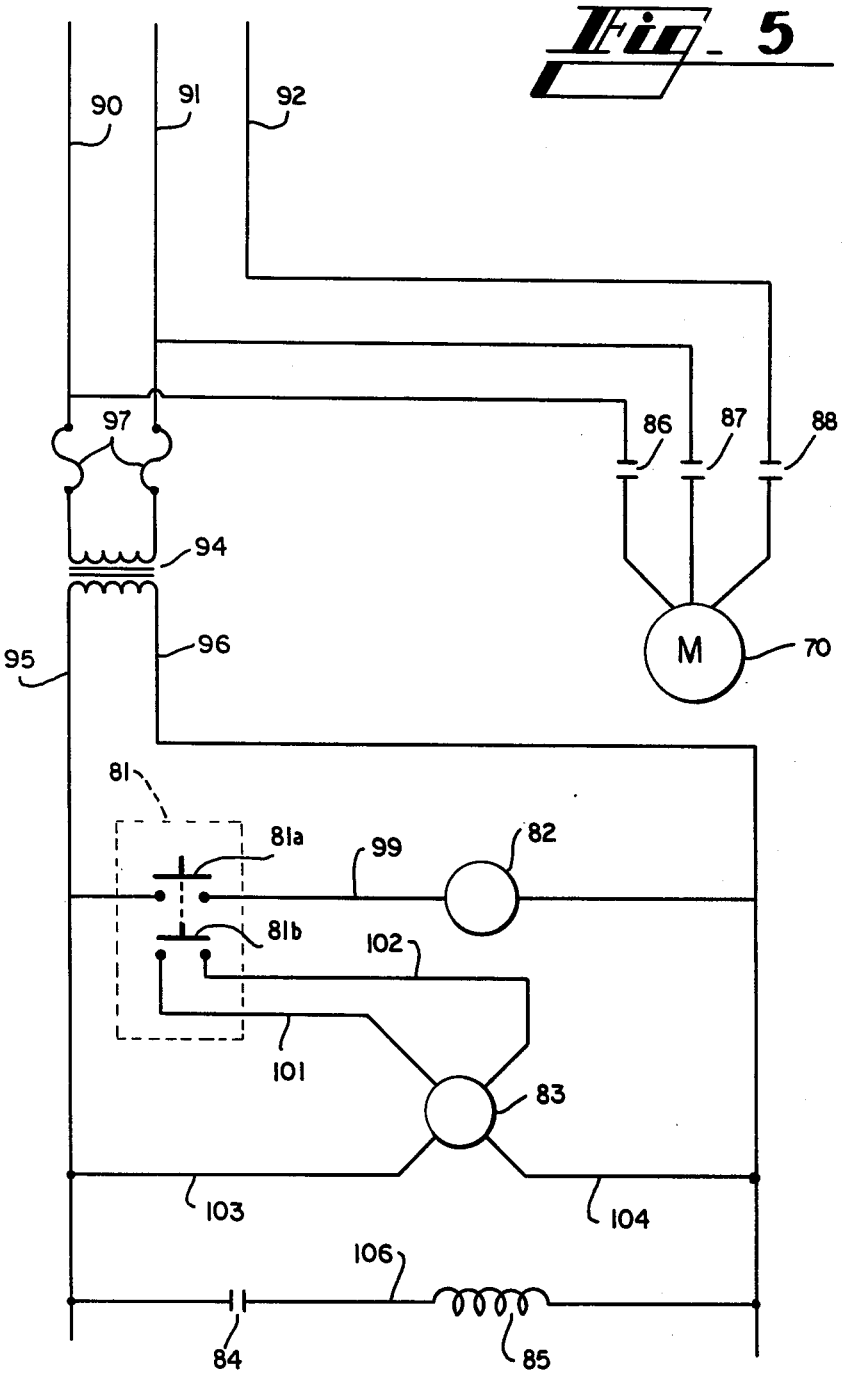
FIG. 5 is an electrical schematic diagram of the control system of the tube dispensing apparatus.

The electrical control circuitry for the tube dispensing apparatus 10 of the present invention is shown schematically in FIG. 5. The control circuitry comprises a double-contact pushbutton on-off switch 81, the first contact **81*a* of which functions with an air cylinder solenoid valve 82, as described later, to activate the disc operating cylinder 75, and the second contact 81*b* of which functions, as later described, with a timer delay 83, normally open timer relay contact 84 and relay coil 85 to close three normally open motor relay contacts 86, 87, 88 and activate the roller operating motor 70. The roller operating motor 70 is, in the disclosed embodiment, supplied by three conductors 90, 91, 92 with 230/460 volt, three-phase alternating current, and a transformer 94 steps down 230 volt current from two of the supply conductors 90, 91 to supply 115 volt current through conductors 95, 96 to the remaining control circuitry. The conductors 90, 91 are each provided with a fuse 97 at the transformer 94**.

In operation: a plurality of carpet tubes or cores 120, preferably of approximately equal diameter, are placed by a fork lift, or otherwise, into the hopper 35. Easy access is had to the hopper 35 from the side of the hopper opposite the triangular end wall 38. The tubes 120 lie upon the inclined structural wall 20 and the weight of the tubes directs them downward toward the outlet end of the hopper. At the outlet end, the front rail 12 stops the tubes above the outlet opening 54. Since the width of the outlet opening 54 is less than the combined diameters of any two tubes 120, only a single tube will enter the opening at a time while others line up or amass above it.

In the normal at-rest position of the tube dispensing apparatus 10, the grooves 64 are in the tube collecting position directly beneath the outlet opening 54 and thus, the first tube through the opening will fall into the horizontally aligned grooves 64. The grooved discs 62, therefore, function as a collecting or cradling device to hold one tube 120 at a time as the tube leaves the outlet opening 54. The depth of the grooves 64 is preferably less than the diameter of a single tube **120*a*, in order that a second tube 120*b* coming through the opening above the first tube 120*a* will not interfere with the rotation of the discs 62. Similarly, the depth of the grooves 64 is large enough that a tube 120 cradled in the grooves will pass without interference under the lower edge 65 of beam 15 when the discs 62 are rotated. The first tube 120*a* is dispensed from the apparatus 10 by extending the ram element 70 to rotate the discs 62** to the dispensing position.

As the discs 62 are rotating from the collecting position to the dispensing position, the second tube **120*b* will drop further in the outlet opening 54 until it contacts the outer periphery 63 of the discs 62. Since the distances between the lower edges 65, 66 of the beam 15 and elongated plate 52, respectively, and the outer periphery 63 of the discs 62 are less than the diameter of a tube 120, the tube 120*b* will not come completely out of the opening until the grooves 64** are again returned to the collecting position.

The roller 45 and cubes 47 function as a stirring device with the protruding ridges 51 of the angle irons 49 functioning as paddles. Roller 45 is rotated by the roller operating motor 70 in the direction of arrow B in FIG. 1 and thus, the protruding ridges 51 move through a circular path. The movement of each protruding ridge 51 is generally directed away from the outlet opening 54 while the ridge is present within the confines of the hopper 35, that is, while the ridge 51 is exposed to contact with tubes 120 within the hopper 35 and until the ridge disappears to the underside of the inclined structural wall 20. As the roller 45 rotates, the paddles, ridges 51, contact the tubes 120 and "kick" the tubes upward away from the opening 54 in order to stir the tubes and aid in loosening tangled or bound-up tubes in order that the tubes will move one at a time into the outlet opening. The shield plates 56 prevent tubes 120 from dropping down into the spaces between the roller 45 and the elongated plate 52 or between the roller 45 and the beam 24.

The protruding ridges 51 of the angle irons 49 are preferably ground so as to remove any sharp edges that may damage the tubes. The present invention utilizes angle irons 49 with 90 degree angles and flat leg portions 50 to form cubes 47 about the roller 45 in order that the stirring of the tubes will be smooth and gentle to avoid damaging the tubes. However, protrusions of various other designs can be used to stir the tubes.

Each time a tube 120 is desired to be dispensed from the apparatus 10, the operator presses the "on-off" switch 81 which simultaneously closes the two contacts 81*a* and 81*b*. Closing of contact 81*a* causes current to flow from conductor 95 through the contact 81*a*, conductor 99 and the air cylinder solenoid valve 82 to common conductor 96, thus activating the solenoid valve causing the ram element 70 of the disc operating cylinder 75 to extend thus rotating the bar 60 and discs 62 to the tube-dispensing position at which the tube 120 falls from the grooves 64 into a carpet roll up machine 110 (see FIG. 3) or other desired collection device. The pushbutton on-off switch 81 is spring loaded to return contacts 81*a*, 81*b* to their normally open position once the operator removes pressure which breaks the circuit to the solenoid valve 82 thus allowing the ram element 79 to be retracted by the cylinder 75 returning the disc and bar assembly to the tube-collecting position after the ram element 79 has first been fully extended.

Simultaneously as contact 81*a* is closed by pressing the on-off switch 81, contact 81*b* is closed completing the circuit between conductor 101 and conductor 102 and allowing current to flow from conductor 95 through the timer delay 83 along conductor 103, 101, 102 and 104 to common conductor 96, thus energizing the timer delay 83. Current flows from conductor 103 to conductor 104 through the timer delay 83 for a predetermined period of time after the opening of contact 81*b* by virtue of the delay timer mechanism. During the time that current is flowing through the timer delay 83, the timer delay is energized thus closing normally open timer relay contact 84 and completing the circuit from conductor 95 through contact 84, conductor 106 and relay coil 85 to common 96. Completing the circuit through coil 85 energizes the coil 85 thus closing the three motor relay contacts 86, 87, 88 and completing the circuits from conductors 90, 91 and 92 to the roller operating motor 70 to thus energize the motor to rotate the roller 45 and the cubes 47.

Therefore, the disc operating cylinder 75 and roller operating motor 70 are switched on simultaneously. The discs 62 dispense a tube 120 and return to collect another tube while the roller 45 rotates and the roller 45 continues to rotate for a predetermined time, for example two or three seconds, after the discs have returned to the tube-collecting position. As the roller 45 rotates, the paddles, or ridges 51, of the cubes 47 move into and out of contact with tubes 120 within the hopper 35 to "stir" the tubes as earlier described. Once the ram element 79 of the disc operating cylinder 75 is retracted to the at-rest position with the discs in the tube-collecting position, the ram element will not extend again to dispense another tube 120 until the on-off switch 81 is again pressed by the operator. Likewise, after the timer mechanism of the timer delay 83 cuts out, the roller operating motor 70 will stop operating until the on-off switch 81 is again pressed.

Figure 3:
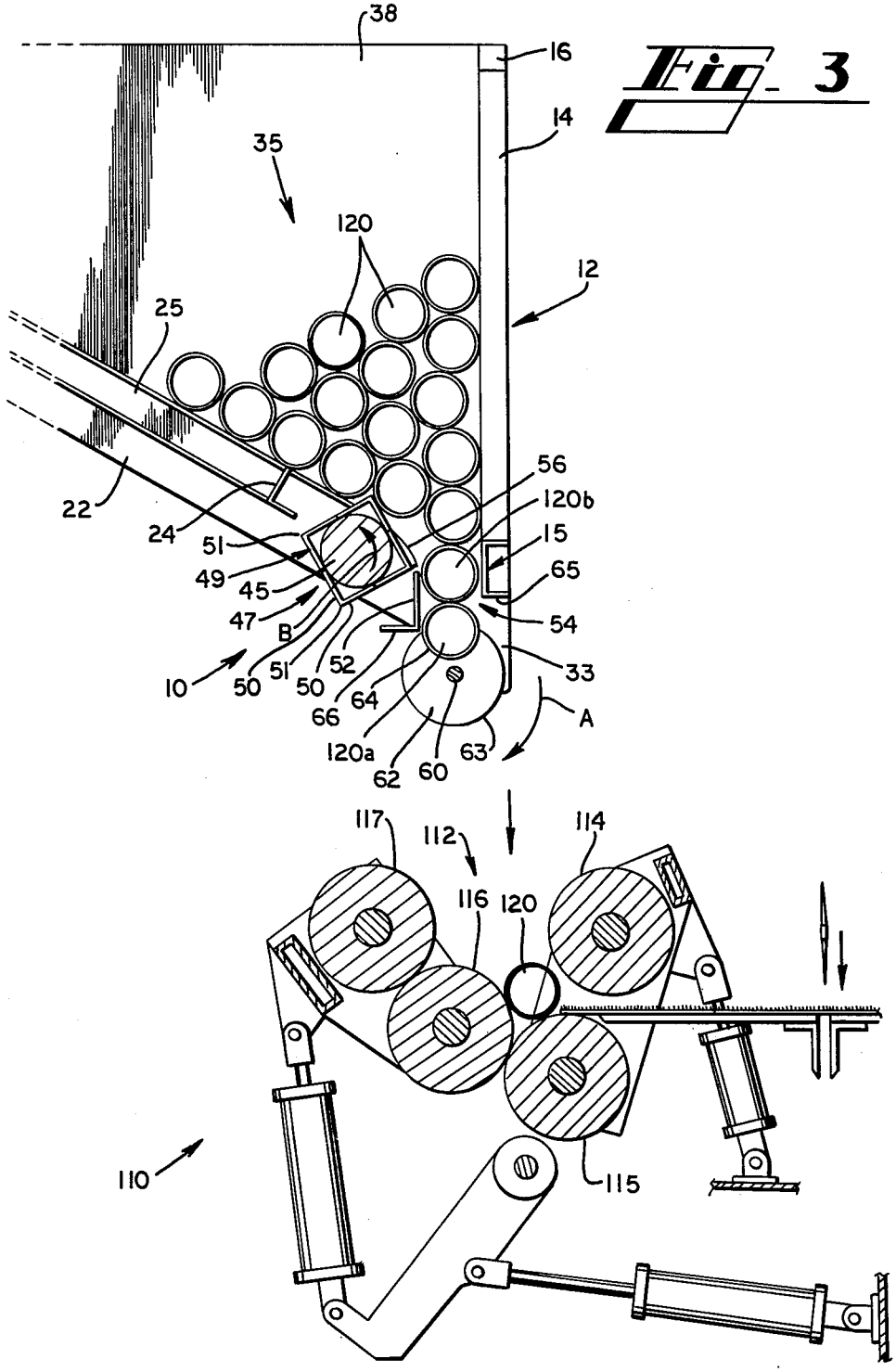
FIG. 3 is a left side view of the tube dispensing apparatus of FIG. 1, with parts broken away for clarity, and which include tubes held within the dispensing apparatus, and further includes a schematic representation of a carpet roll-up machine.

As seen in FIG. 3, the tube dispensing apparatus 10 is intended for use in combination with a carpet roll-up machine 110. Preferably, the apparatus 10 is combined with the roll-up machine disclosed and described in applicant's prior U.S. Pat. No. 4,102,512. The tube 120 is dispensed from the grooves 64 of the dispensing apparatus 10 to fall directly into the space 112 between the cluster of roll-up rollers 114–117, while the cluster is opened up as seen in FIG. 3. After the tube has fallen into the space 112, the cluster of rollers 114–117 is closed up to begin the roll-up operation in accordance with the disclosure of the above mentioned patent.

While this invention has been described in detail with particular reference to a preferred embodiment thereof, it will be understood that variations and modifications can be effected within the spirit and scope of the invention as described hereinbefore and as defined in the appended claims.

I claim:

1. Apparatus for dispensing elongated tubes to be used in a carpet roll-up machine, comprising:

a hopper for holding a plurality of elongated tubes therein, said hopper including at least one sloped wall and defining at the lower end portion of said sloped wall an elongated, horizontally oriented outlet opening through which the tubes can leave said hopper one tube at a time;

agitation means including protrusions movable upwardly through said sloped wall at a level above said outlet opening and in a direction away from said outlet opening for agitating the tubes within the hopper and aligning one tube at a time within said outlet opening; and a tube collecting and dispensing means for collection one tube at a time from said outlet opening and dispensing the tubes one at a time, said collecting means positioned below said outlet opening of said hopper and comprising a plurality of disc elements each mounted in spaced axial alignment with one another on a rotatable bar and each disc element defining a peripheral groove in alignment with the grooves of the other discs and arranged to rotate with said bar between positions where the grooves are located beneath said outlet opening for receiving a tube from the outlet opening and a position where the grooves face downwardly for dispensing a tube therefrom.

2. Apparatus for dispensing elongated tubes to be used in a carpet roll-up machine, comprising:

a hopper for holding a plurality of elongated tubes therein including a tube inlet to said hopper and a tube outlet located below said tube inlet, said tube outlet comprising an elongated horizontal opening positioned at a lower end of said hopper through which the tubes can leave said hopper one tube at a time with the longitudinal axis of the elongated tubes oriented horizontally as the tubes leave the hopper through the outlet;

stirring means for periodically stirring tubes within the hopper to arrange the tubes in parallel alignment, said stirring means being located above and adjacent said opening of said outlet and including at least one protrusion for extending at least partly into said hopper, said protrusion being movable along a path within said hopper in a direction away from said horizontal opening for moving into and out of engagement with tubes held within said hopper; and tube collecting and dispensing means for collecting one tube at a time from said outlet of said hopper and dispensing the tubes one at a time, said collecting and dispensing means comprising a movable elongated cradling device positioned beneath said elongated opening of said hopper to receive a tube leaving said hopper through said opening, said cradling device comprising an elongated bar pivotable about its longitudinal axis, and a plurality of spaced apart discs mounted on and rotatable with said bar, each said disc including a groove defined therein for accepting the convex outer surface of a tube therein, the groove of each said disc being in horizontal alignment with the groove of each adjacent disc, and the grooves being positioned beneath the opening of the outlet when said cradling device is in a position for collecting a tube, means for moving the grooves of said cradling device from a position beneath said opening for collecting a tube to a position for dispensing the tube from said cradling device and back to said position for collecting whereby the outer periphery of each disc moves into a position beneath said opening for blocking the movement of the next tube in the opening of said outlet, said means for moving said cradling device comprising a ram element operatively connected to said elongated bar, said ram element being extendable to pivot said bar about its longitudinal axis to move said cradling device to its position for dispensing and being retractable to pivot said bar to move said cradling device to its position for collecting;

whereby said stirring means moves within said hopper to engage tubes placed therein to arrange the tubes in parallel alignment and thus position one tube at a time in said opening of said outlet, the grooves of said elongated cradling device are positionable beneath said opening to collect a tube from said opening, a tube enters said cradling device from said opening once said cradling device is in said position for collecting a tube, and said means for moving said cradling device moves said cradling device to said position for dispensing the tube and then back to said position for collecting once the tube has been dispensed.

3. Apparatus of claim 2, wherein said stirring means comprises an elongated roller rotatable about its own longitudinal axis and extending along the length of said hopper parallel to and above said elongated horizontal opening, and motor means for rotating said roller, said roller located with a portion of the circumference of said roller positioned outside said hopper, and said protrusion being attached to and protruding from the periphery of said roller and being rotatable with said roller whereby as said roller rotates said protrusion moves into and out of said hopper along an arcuate path and in a direction away from said elongated horizontal opening.

4. Apparatus of claim 3, further comprising means for activating said motor means for rotating said roller each time said cradling device moves to said position for dispensing and means for maintaining the rotation of said roller for a period of time after said cradling device has been moved to said position for dispensing.

5. An apparatus for dispensing elongated tubes, comprising the combination of:

a hopper for holding a plurality of elongated tubes therein, said hopper including an elongated, horizontally oriented outlet opening through which the tubes can leave said hopper one tube at a time;

agitation means for agitating the tubes within the hopper and aligning one tube at a time within said outlet opening;

a tube collecting and dispensing means for collecting one tube at a time from said outlet opening and dispensing the tubes one at a time, said collecting means positioned adjacent said outlet opening of said hopper and collecting each said tube as said tube leaves said opening; and a carpet roll-up means located beneath said outlet opening of said hopper for receiving the tubes dispensed from said collecting and dispensing means and for rolling carpet segments onto the tube, said roll-up means including a plurality of elongated parallel rotatable rollers being movable to define a space for receiving a tube therein, means for moving said rollers to hold the tube within said space and means for rotating said rollers including means for drawing a carpet segment into said space and means for rolling the carpet about the tube.

* * * * *